US009660394B2

(12) United States Patent
Zien et al.

(10) Patent No.: US 9,660,394 B2
(45) Date of Patent: May 23, 2017

(54) RECONFIGURABLE PLUG STRIP

(71) Applicant: Q Holdings LLC, New York, NY (US)

(72) Inventors: Jacob Daniel Zien, New York, NY (US); Jordan Diatlo, New York, NY (US); Kate Sarah Vallon, New York, NY (US); Steven Richard Remy, New York, NY (US); Richard Ganas, New York, NY (US); David Sutton, New York, NY (US); Nicholas Oxley, New York, NY (US)

(73) Assignee: Q Holdings LLC, New York, NY (US)

( * ) Notice: Subject to any disclaimer, the term of this patent is extended or adjusted under 35 U.S.C. 154(b) by 0 days.

(21) Appl. No.: 14/687,225

(22) Filed: Apr. 15, 2015

(65) Prior Publication Data

US 2015/0364873 A1 Dec. 17, 2015

Related U.S. Application Data

(63) Continuation of application No. 14/149,612, filed on Jan. 7, 2014, now Pat. No. 9,028,274, which is a (Continued)

(51) Int. Cl.
*H01R 13/60* (2006.01)
*H01R 13/713* (2006.01)
(Continued)

(52) U.S. Cl.
CPC ..... *H01R 13/7135* (2013.01); *H01R 13/514* (2013.01); *H01R 13/717* (2013.01);
(Continued)

(58) Field of Classification Search
CPC .. H01R 13/7135; H01R 25/00; H01R 13/717; H01R 35/04; H01R 13/514;
(Continued)

(56) References Cited

U.S. PATENT DOCUMENTS 2,134,355 A 7/1934 Caldwell
3,437,976 A 4/1969 Nelson
(Continued)

FOREIGN PATENT DOCUMENTS

CN 101562304 10/2009
CN 202737189 2/2013
(Continued)

OTHER PUBLICATIONS

International Search Report for International Application No. PCT/US2011/051522, mailed Feb. 28, 2012, 17 pages.
(Continued)

*Primary Examiner* — Jean F Duverne
(74) *Attorney, Agent, or Firm* — Hard IP LLC

(57) ABSTRACT

An apparatus includes a base segment having a signal port coupler configured to selectively conductively engage with a signal port. A first assembly includes a first segment movably coupled to the base segment and a second segment movably coupled to the first segment, and a second assembly includes a third segment movably coupled to the base segment and a fourth segment movably coupled to the third segment. The first, second, third, and fourth segments include receptacles configured to receive at least an electrically conductive portion of a device plug. An electrical connection assembly is disposed in the base, first, second, third, and fourth segments and is configured to selectively conductively engage the receptacles of the first, second, third, and fourth segments with a signal port.

20 Claims, 13 Drawing Sheets

Related U.S. Application Data continuation-in-part of application No. 13/962,627, filed on Aug. 8, 2013, which is a continuation of application No. 13/568,833, filed on Aug. 7, 2012, now Pat. No. 8,529,289, which is a continuation of application No. 13/095,167, filed on Apr. 27, 2011, now Pat. No. 8,262,399.

(60) Provisional application No. 61/803,504, filed on Mar. 20, 2013, provisional application No. 61/749,608, filed on Jan. 7, 2013.

(51) Int. Cl.

| | |
|---|---|
| ***H01R 13/514*** | (2006.01) |
| ***H01R 25/00*** | (2006.01) |
| ***H01R 29/00*** | (2006.01) |
| ***H01R 35/04*** | (2006.01) |
| ***H01R 13/717*** | (2006.01) |
| *H01R 13/641* | (2006.01) |
| *H01R 13/66* | (2006.01) |
| *H01R 13/70* | (2006.01) |
| *H01R 35/02* | (2006.01) |

(52) U.S. Cl.

CPC ..... *H01R 25/00* (2013.01); *H01R 25/003* (2013.01); *H01R 29/00* (2013.01); *H01R 35/04* (2013.01); *H01R 13/641* (2013.01); *H01R 13/66* (2013.01); *H01R 13/6658* (2013.01); *H01R 13/70* (2013.01); *H01R 35/025* (2013.01)

(58) Field of Classification Search

CPC .... H01R 25/003; H01R 13/641; H01R 13/66; H01R 13/70; H01R 35/025; H01R 13/6658

USPC ..... 439/527

See application file for complete search history.

(56) References Cited

U.S. PATENT DOCUMENTS

| | | | | |
|---|---|---|---|---|
| 3,771,106 | A | 11/1973 | Matsumoto et al. | |
| 3,951,487 | A | 4/1976 | Waldbrook | |
| 4,583,798 | A | 4/1986 | Blazowich | |
| 5,292,257 | A | 3/1994 | Milan | |
| 5,484,299 | A | 1/1996 | Schlessinger | |
| D381,315 | S | 7/1997 | Harold | |
| D401,220 | S | 11/1998 | Dwight et al. | |
| 5,902,140 | A | 5/1999 | Cheung et al. | |
| 5,967,815 | A | 10/1999 | Schlessinger et al. | |
| D416,860 | S | 11/1999 | Seiwert et al. | |
| 6,068,490 | A | 5/2000 | Salzberg | |
| 6,196,851 | B1 | 3/2001 | Gerard et al. | |
| 6,229,107 | B1 | 5/2001 | Flint et al. | |
| D445,403 | S | 7/2001 | Veino et al. | |
| 6,793,499 | B1 | 9/2004 | Chen | |
| 6,862,403 | B2 | 3/2005 | Pedrotti et al. | |
| D507,237 | S | 7/2005 | Gregory | |
| D514,067 | S | 1/2006 | Lee | |
| 6,991,495 | B1 | 1/2006 | Aromin | |
| 7,125,256 | B2 | 10/2006 | Gerard | |
| 7,238,028 | B2 | 7/2007 | Gerard | |
| 7,247,028 | B2 | 7/2007 | Schriefer | |
| 7,264,514 | B2 | 9/2007 | Hsu et al. | |
| 7,278,878 | B2 | 10/2007 | Draggie et al. | |
| D556,689 | S | 12/2007 | Lee et al. | |
| 7,435,091 | B1 | 10/2008 | Cruz | |
| 7,488,204 | B2 | 2/2009 | Hsu | |
| 7,500,854 | B2 | 3/2009 | Gottstein | |
| D597,948 | S | 8/2009 | Bizzell | |
| 7,625,241 | B2 * | 12/2009 | Axland | H01R 25/006 439/640 |
| 7,753,682 | B2 | 7/2010 | Gerard | |
| 7,771,239 | B1 | 8/2010 | Hsiao | |
| 7,811,136 | B1 | 10/2010 | Hsieh et al. | |
| 7,824,185 | B2 * | 11/2010 | Chien | H04N 7/181 439/11 |
| 7,874,856 | B1 * | 1/2011 | Schriefer | H01R 13/514 439/214 |
| D633,045 | S | 2/2011 | Cullen et al. | |
| D640,199 | S | 6/2011 | Wilson | |
| 8,011,930 | B2 | 9/2011 | Lee et al. | |
| 8,025,527 | B1 | 9/2011 | Draggie et al. | |
| D651,174 | S | 12/2011 | Le Clair | |
| 8,118,616 | B1 * | 2/2012 | Clark | H01R 25/006 439/640 |
| 8,157,574 | B2 | 4/2012 | Hsiao | |
| 8,262,399 | B1 * | 9/2012 | Zien | H01R 25/003 439/188 |
| 8,500,484 | B2 * | 8/2013 | Hu | H01R 24/22 439/527 |
| 8,500,492 | B2 | 8/2013 | Brown | |
| 8,529,289 | B2 | 9/2013 | Zien et al. | |
| 9,028,274 | B2 | 5/2015 | Zien | |
| 2005/0032396 | A1 | 2/2005 | Huang | |
| 2006/0068608 | A1 | 3/2006 | McFadden | |
| 2006/0234561 | A1 | 10/2006 | Tanaka | |
| 2007/0178756 | A1 | 8/2007 | Schriefer et al. | |
| 2008/0231121 | A1 | 9/2008 | Yang | |
| 2012/0028505 | A1 * | 2/2012 | Weber | H01R 25/003 439/638 |
| 2012/0108101 | A1 | 5/2012 | Hu | |
| 2014/0102870 | A1 | 4/2014 | Zien et al. | |
| 2014/0187079 | A1 | 7/2014 | Zien et al. | |

FOREIGN PATENT DOCUMENTS

| | | |
|---|---|---|
| DE | 20313536 | 12/2003 |
| DE | 102005046465 | 4/2007 |
| EP | 0702433 | 3/1996 |
| JP | 2000-277222 | 10/2000 |
| JP | 2005-056758 | 3/2005 |
| RU | 2283521 | 9/2006 |
| RU | 2316090 | 1/2008 |
| SU | 466689 | 4/1975 |
| SU | 838832 | 6/1981 |
| WO | WO2009/0104162 | 8/2009 |
| WO | WO2010/0127606 | 11/2010 |
| WO | WO2012/148440 | 11/2012 |

OTHER PUBLICATIONS

International Search Report and Written Opinion for International Application No. PCT/US2014/010541, mailed May 2, 2014, 8 pages.

Office Action for Chinese Patent Application 201320033486.X, dated Oct. 11, 2013, 4 pages.

Office Action for Chinese Patent Application 201320033486.X, dated Jun. 5, 2013, 4 pages.

Office Action for Chinese Patent Application 201220035403.6, dated Jul. 18, 2012, 4 pages.

Office Action for U.S. Appl. No. 13/568,833, mailed Feb. 8, 2013, 6 pages.

European Extended Search Report EP Application No. 14735136.5 dated Oct. 10, 2016, 9 pages.

Notice of Allowance for U.S. Appl. No. 13/095,167 mailed Jun. 25, 2012, 7 pages.

European Search Report dated Oct. 27, 2016 received in EP Application No. 14735136.5, 5 pages.

* cited by examiner

100

100

525

RECONFIGURABLE PLUG STRIP

CROSS-REFERENCE TO RELATED APPLICATIONS

This application claims the priority to and benefit of U.S. Provisional Patent Application No. 61/749,608, filed Jan. 7, 2013, and U.S. Provisional Patent Application No. 61/803,504, filed Mar. 20, 2013, the disclosures of each of which are hereby incorporated by reference in their entirety.

This application is also a continuation of U.S. patent application Ser. No. 14/149,612, filed Jan. 7, 2014, now U.S. Pat. No. 9,028,274, which is a continuation-in-part of U.S. patent application Ser. No. 13/962,627, filed Aug. 8, 2013, and which claims benefit of U.S. Patent Application No. 61/803,504, filed Mar. 20, 2013 and claims benefit of U.S. Patent Application No. 61/749,608, filed Jan. 7, 2013, U.S. patent application Ser. No. 13/962,627 being a continuation of U.S. Ser. No. 13/568,833, filed Aug. 7, 2012, now U.S. Pat. No. 8,529,289, which is a continuation of U.S. patent application Ser. No. 13/095,167, filed Apr. 27, 2011, now U.S. Pat. No. 8,262,399, the disclosures of each of which are hereby incorporated by reference in their entirety.

BACKGROUND

Embodiments described herein relate generally to plug strips, and in particular to reconfigurable plug strips.

Currently, electrical and other outlets typically include a limited number of outlets usable to plug in devices requiring electrical power, or requiring access to a signal path and/or a signal source. When additional outlets are needed, a plug strip can be coupled to a permanent outlet, which increases the number of outlets available. However, the outlets on such plug strips may be oriented so that devices such as power adapters having large housings in fixed orientation with respect to their electrical plugs can obstruct some of the outlets, reducing the benefit of the plug strip. Furthermore, the length and/or width of the plug strip can limit the locations where the plug strip can be placed.

Thus a need exists for a reconfigurable plug strip.

SUMMARY

In some embodiments, an apparatus includes a base segment having a signal port coupler configured to selectively conductively engage with a signal port. A first assembly includes a first segment movably coupled to the base segment and a second segment movably coupled to the first segment. The first segment includes a first receptacle configured to receive at least an electrically conductive portion of a first device plug, and a second segment includes a second receptacle configured to receive at least an electrically conductive portion of a second device plug. The apparatus also includes a second assembly including a third segment movably coupled to the base segment and a fourth segment movably coupled to the third segment. The third segment includes a third receptacle configured to receive at least an electrically conductive portion of a third device plug, and a fourth segment includes a fourth receptacle configured to receive at least an electrically conductive portion of a fourth device plug. An electrical connection assembly is disposed in the base, first, second, third, and fourth segments and is configured to selectively conductively engage the receptacles of the first, second, third, and fourth segments with a signal port.

DETAILED DESCRIPTION

Figure 1A:
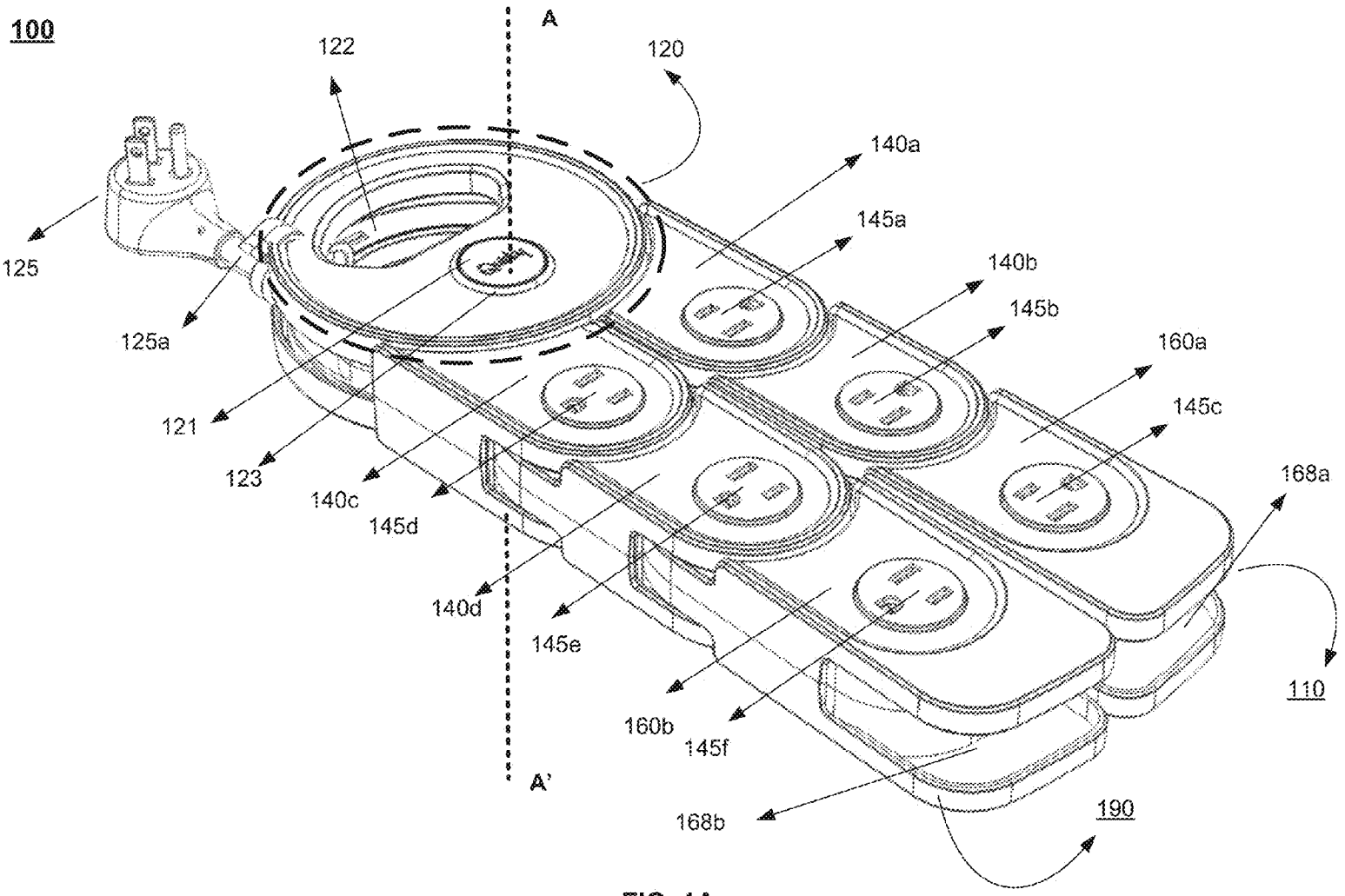
FIG. 1A is a perspective view of a plug strip in a first configuration, according to an embodiment.
Figure 1B:
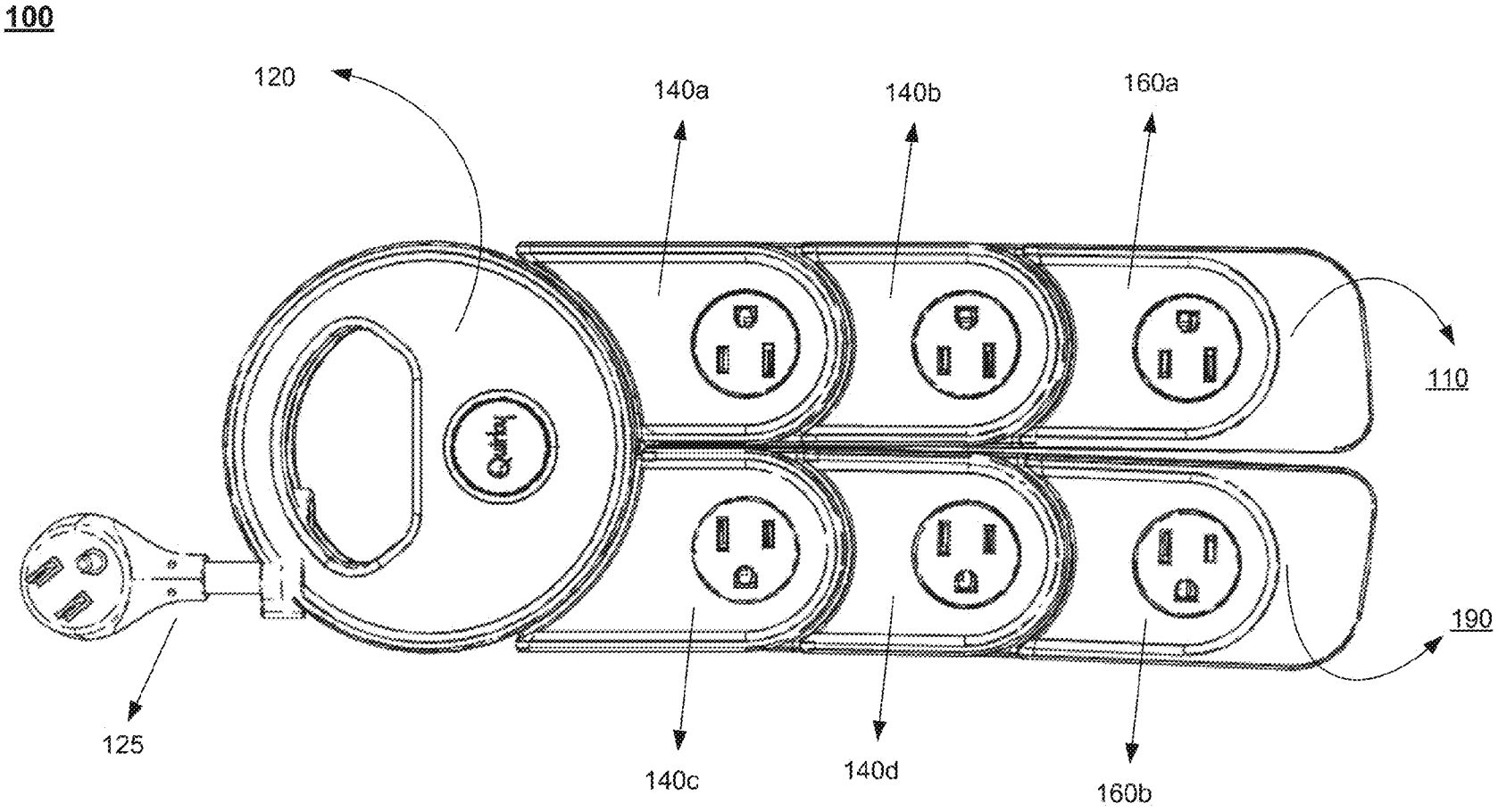
FIG. 1B is a top view of the plug strip of FIG. 1A.
Figure 1C:
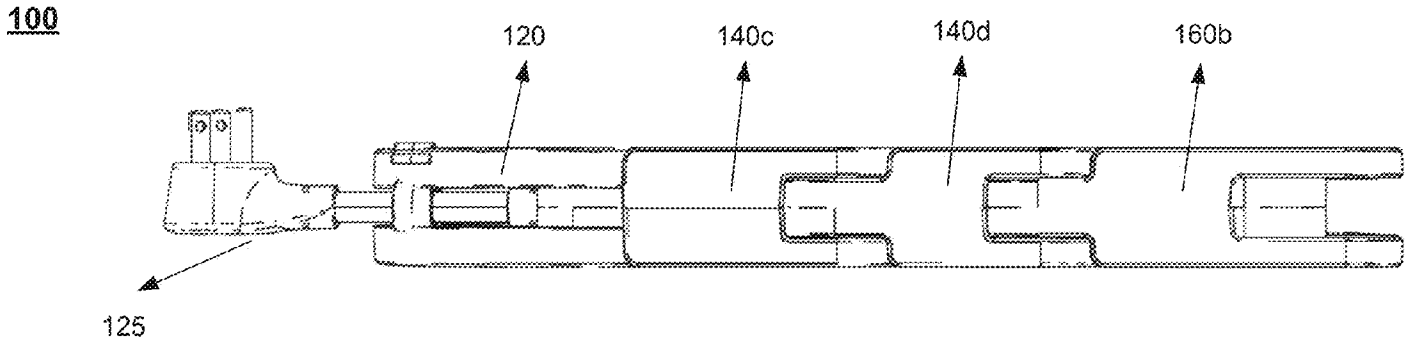
FIG. 1C is a side view of the plug strip of FIG. 1A.
Figure 1D:
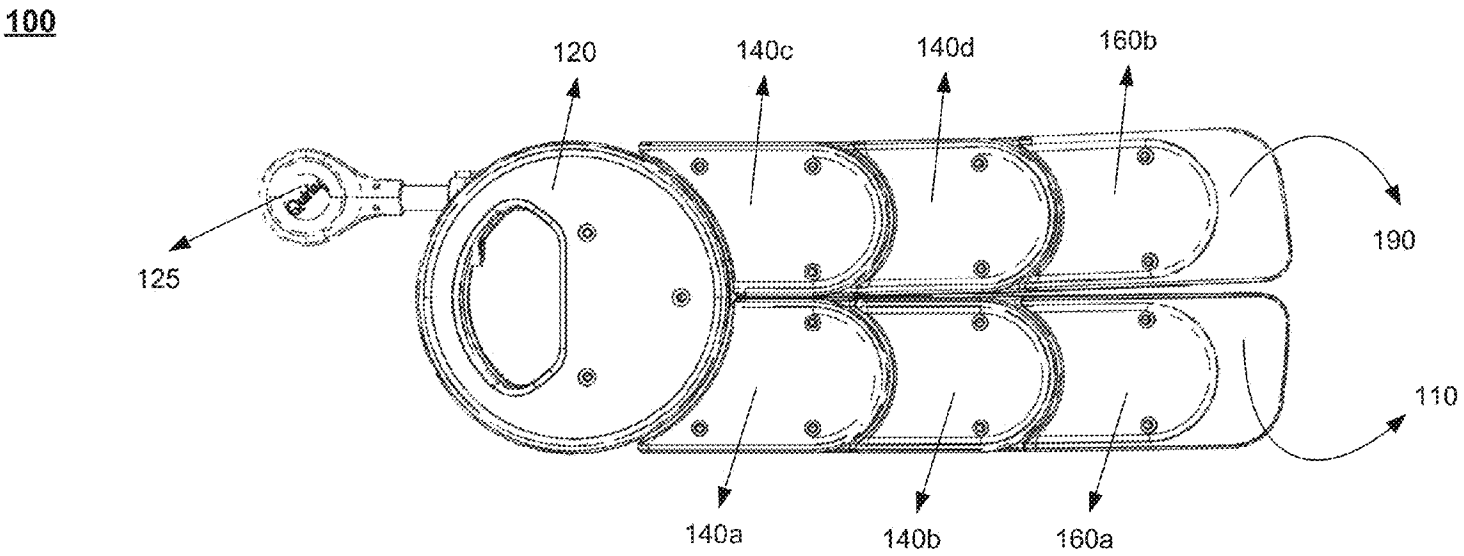
FIG. 1D is a bottom view of the plug strip of FIG. 1A.
Figure 1E:
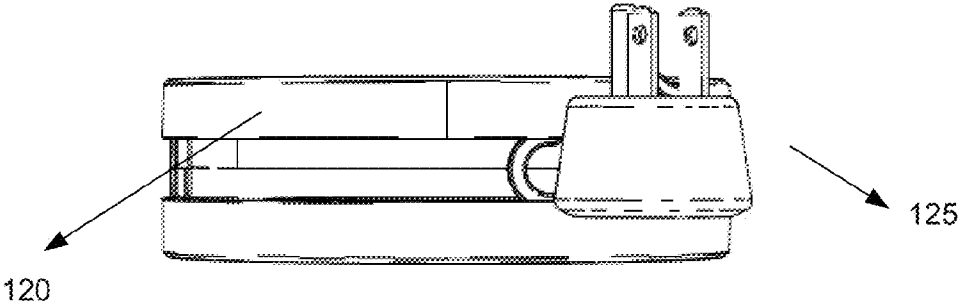
FIG. 1E is a front view of the plug strip of FIG. 1A.
Figure 1F:
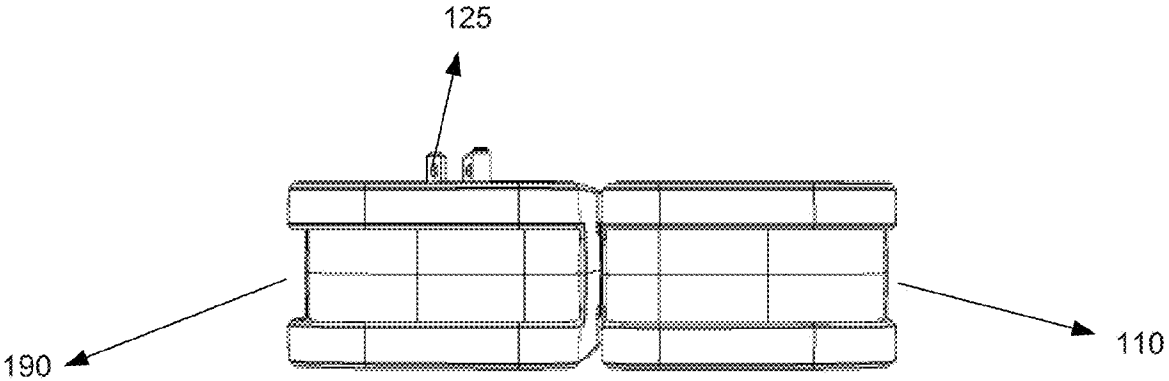
FIG. 1F is a back view of the plug strip of FIG. 1A.

In some embodiments, an apparatus includes a base segment including a signal port coupler that is configured to selectively conductively engage with a signal port. In such embodiments, the apparatus also includes a first assembly, where the first assembly includes a first segment movably coupled to the base segment. The first segment also includes a first electrical receptacle configured to receive at least an electrically conductive portion of a first device plug. In such embodiments, the first assembly also includes a second segment that can include a second receptacle that is configured to receive at least an electrically conductive portion of a second device plug. In such embodiments, the second segment is coupled to the first segment for pivotal movement relative to the first segment. In such embodiments, the apparatus includes a second assembly, where the second assembly includes a third segment movably coupled to the base segment, and where the third segment includes a third electrical receptacle that is configured to receive at least an electrically conductive portion of a third device plug. The second assembly also includes a fourth segment that can include a fourth electrical receptacle configured to receive at least an electrically conductive portion of a fourth device plug. The fourth segment is coupled to the third segment for pivotal movement relative to the third segment. In such embodiments, the apparatus includes an electrical connection assembly disposed in the base, first, second, third, and fourth segments that can selectively conductively engage the electrical receptacles of the first, second, third, and fourth segments with a signal port.

In some embodiments, an apparatus includes a base segment including a signal port coupler that can selectively conductively engage with a signal port. In such embodiments, the apparatus also includes a first assembly including a first segment movably coupled to the base segment. The first segment also includes a single receptacle that can receive at least an electrically conductive portion of a first device plug. The first assembly can also include a second segment that includes a single electrical receptacle configured to receive at least an electrically conductive portion of a second device plug. The second segment is coupled to the first segment for pivotal movement relative to the first segment. In such embodiments, the apparatus also includes a second assembly including a third segment that is movably coupled to the base segment. The third segment includes a single electrical receptacle that is configured to receive at least an electrically conductive portion of a third device plug. The second assembly also includes a fourth segment that includes a single electrical receptacle configured to receive at least an electrically conductive portion of a fourth device plug. The fourth segment is coupled to the third segment for pivotal movement relative to the third segment. In such embodiments, the apparatus also includes an electrical connection assembly disposed in the base, first, second, third, and fourth segments that is configured to selectively conductively engage the electrical receptacles of the first, second, third, and fourth segments with a signal port.

In some embodiments, an apparatus includes a base segment including a signal port coupler that can selectively conductively engage with a signal port. In such embodiments, the apparatus also includes a first assembly that includes a first segment movably coupled to the base segment. The first segment also includes a first electrical receptacle configured to receive at least an electrically conductive portion of a first device plug. The first segment includes a ring member disposed about the base segment and configured to allow the first segment to rotate around the base segment. The first assembly also includes a second segment that is movably coupled to the first segment, where the second segment includes a second electrical receptacle configured to receive at least an electrically conductive portion of a second device plug. In such embodiments, the apparatus also includes a second assembly including a third segment movably coupled to the base segment. The third segment includes a third electrical receptacle configured to receive at least an electrically conductive portion of a third device plug. The third segment includes a ring member disposed about the base segment and configured to allow the third segment to rotate around the base segment. The second assembly also includes a fourth segment that includes a fourth electrical receptacle configured to receive at least an electrically conductive portion of a fourth device plug. Additionally, in such embodiments, the apparatus also includes an electrical connection assembly disposed in the base, first, second, third, and fourth segments that is configured to selectively conductively engage the electrical receptacles of the first, second, third, and fourth segments with a signal port.

As used in this specification, the singular forms "a," "an" and "the" include plural referents unless the context clearly dictates otherwise. Thus, for example, the term "rotation post" is intended to mean a single rotation post or a combination of rotation posts.

FIG. 1A is a perspective view of a plug strip in a first configuration, according to an embodiment. Plug strip 100 can be a reconfigurable plug strip, and can include a set of segments movably connected to one or more other segments. Plug strip 100 can be, for example, a 120 volt, 3 prong plug strip. Specifically, plug strip 100 includes a base segment 120, a first assembly 110 and a second assembly 190. The first assembly 110 includes two intermediate segments 140*a* and 140*b* and an end segment 160*a*. Similarly, the second assembly 190 also includes two intermediate segments 140*c* and 140*d* and an end segment 160*b*. The base segment 120 includes a recess 122 that can be configured to receive a portion of a signal port coupler 125. The base segment 120 can also include and/or be operatively coupled to a ring member (not shown in FIGS. 1A-1F) that can allow the first assembly 110 and/or the second assembly 190 to rotate around the base segment 120. Hence, base segment 120 is the pivot point around which the first assembly 110 and the second assembly 190 can rotate. The base segment 120 can also include and/or be operatively coupled to an electrical connection assembly that can be configured to selectively engage the electrical receptacles of the different intermediate segments 140*a*-140*d* and/or the different end segments 160*a*-160*b* as shown in U.S. Pat. No. 8,262,399, (the '399 patent), entitled "Reconfigurable Plug Strip," filed Apr. 27, 2011, the contents of which are hereby incorporated herein by reference in their entirety. Hence, base segment 120 can be configured to define an electrical signal path between the base segment 120 and a signal port, the intermediate segments 140*a*-140*d*, and/or the end segments 160*a*-160*b*. The base segment 120 can also include a retraction mechanism (not shown in FIGS. 1A-1F) that can be used to retract at least a portion of the power cord 125*a*. The base segment 120 also includes a power button 121 and a light indicator 123. The light indicator 123 can display a continuous colored light or flash a colored light when the plug strip 100 is in a first state (e.g., a power-on state) and is operational.

The first assembly 110 includes first intermediate segment 140*a* movably coupled to the base segment 120. The first intermediate segment 140*a* can include a first electrical receptacle 145*a* that can receive at least an electrically conductive portion of a first device plug. The first assembly 110 also includes a second intermediate segment 140*b* that is movably coupled to the first intermediate segment 140*a*. The second intermediate segment 140*b* can include a second electrical receptacle 145*b* that can receive at least an electrically conductive portion of a second device plug. Additionally, the first assembly 120 can include a first end segment 160*a* that is movably coupled to the second intermediate segment 140*b*. The first end segment 160*a* can include a third electrical receptacle 145*c* that can receive at least an electrically conductive portion of a third device plug. The first end segment 160*a* includes a recess 168*a* that can be configured to receive a portion of a signal port coupler 125 (or power cord 125*a*). In some configurations, the first assembly 110 can be movable about the base segment 120 about a single axis in a single plane. For example, the first assembly 110 can be configured to rotate about the base segment 120 around an axis of rotation marked AA' in FIG. 1A from a first position to a second position where the second position is 90 degrees offset from the first position. In other configurations, the base segment 120 and the first assembly 110 may be movable relative to each other in one or more other planes and/or about or along one or more other axes. Similarly, in some configurations, the second intermediate segment 140*b* and the first end segment 160*a* may be movable relative to each other about a single axis in a single plane. In other configurations, the second intermediate segment 140*b* and the first end segment

160*a* may be movable relative to each other in one or more other planes and/or about or along one or more other axes.

The second assembly 190 includes a third intermediate segment 140*c* movably coupled to the base segment 120. The third intermediate segment 140*c* can include a third electrical receptacle 145*c* that can receive at least an electrically conductive portion of a third device plug. The second assembly 190 also includes a fourth intermediate segment 140*d* that is movably coupled to the third intermediate segment 140*c*. The fourth intermediate segment 140*d* can include a fifth electrical receptacle 145*e* that can receive at least an electrically conductive portion of a fifth device plug. Additionally, the second assembly 120 can include a second end segment 160*b* that is movably coupled to the fourth intermediate segment 140*d*. The second end segment 160*b* can include a sixth electrical receptacle 145*f* that can receive at least an electrically conductive portion of a sixth device plug. The second end segment 160*b* includes a recess 168*b* that can be configured to receive a portion of a signal port coupler 125 (or power cord 125*a*). In some configurations, the second assembly 190 can be movable about the base segment 120 about a single axis in a single plane. For example, the second assembly 110 can be configured to rotate in a clockwise direction about the base segment 120 around an axis or rotation marked AA' in FIG. 1A from a first position to a second position where the second position is 90 degrees offset from the first position. In other configurations, the base segment 120 and the second assembly 190 may be movable relative to each other in one or more other planes and/or about or along one or more other axes. Similarly, in some configurations, the fourth intermediate segment 140*d* and the second end segment 160*b* may be movable relative to each other about a single axis in a single plane. In other configurations, the fourth intermediate segment 140*d* and the second end segment 160*b* may be movable relative to each other in one or more other planes and/or about or along one or more other axes. In some configurations, each of the moving segments may lock into two or more positions as defined by the direction of rotation (e.g., fully open, fully closed, etc.). Although FIG. 1A shows the first assembly 110 and the second assembly 190 each to include two intermediate segments, in other embodiments, the first assembly 110 and the second assembly 190 can include more or less than two intermediate segments. Although FIG. 1A shows the each of the intermediate segments 140*a*-140*d* and the end segments 160*a*-160*b* to include a single electrical receptacle 145*a*-145*f*, in other embodiments each of the intermediate segments 140*a*-140*d* and the end segments 160*a*-160*b* can include more than one electrical receptacle.

Figure 1G:
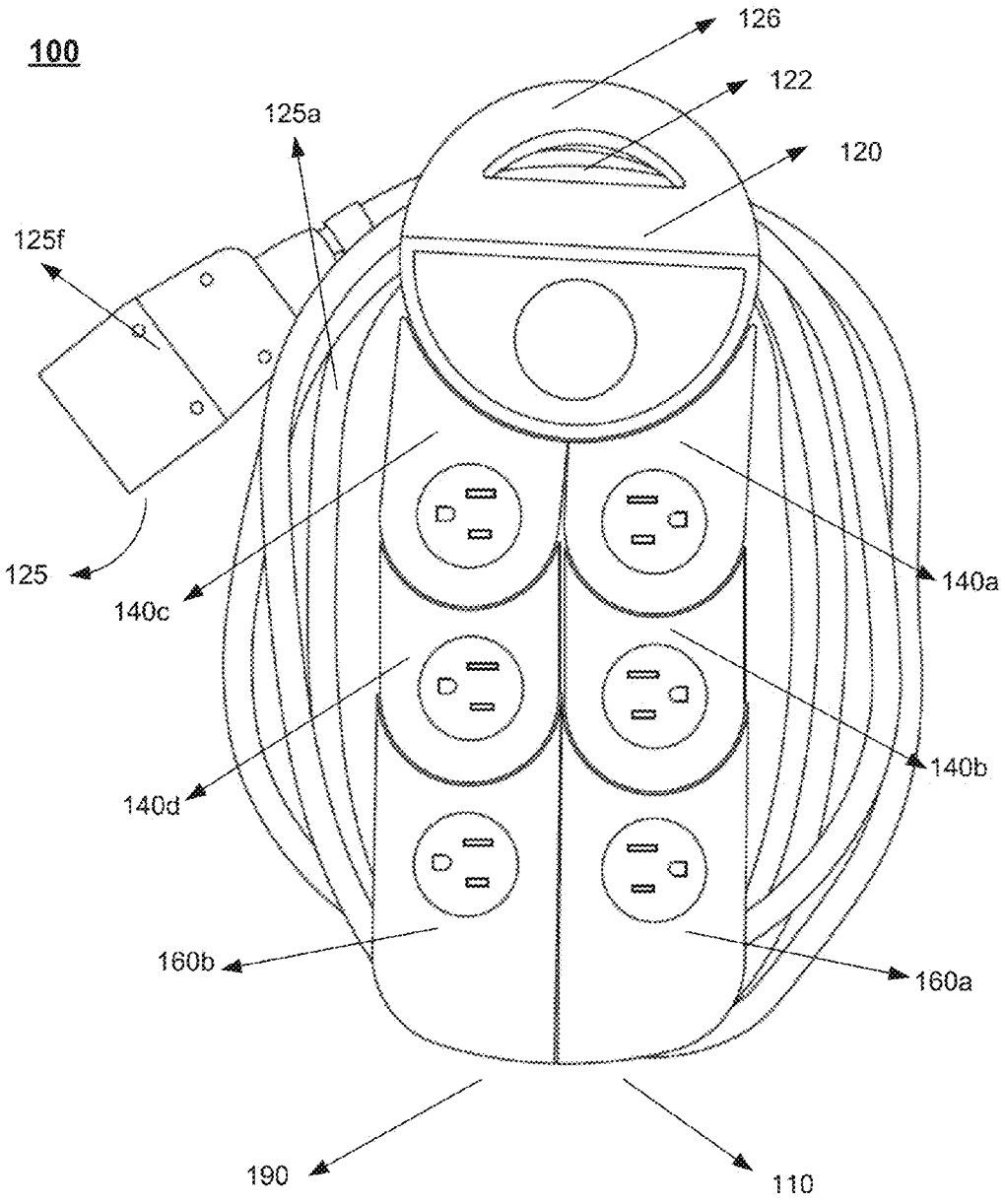
FIG. 1G is a top view of the plug strip, according to an embodiment.

In some embodiments, the plug strip 100 can include a plastic or metal housing (not shown in FIGS. 1A-1F). In such configurations, the housing can be covered by a rubber-over-mould. This rubber-over-mould can provide the plug strip 100 protection against drops and other hazards in harsh environments (e.g., a construction job site). FIG. 1G is a top view of the plug strip in a second configuration, according to an embodiment. In such configurations, the base segment recess 122 is shown to receive a portion of the signal port coupler 125 that includes a power cord 125*a*. In such configurations, the base segment recess 122 and the signal port coupler recess of the two end segments 168*a* and 168*b* permit the power cord 125*a* to be wrapped around the plug strip 100. The base segment recess 122 can define a handle portion 126 that can be used for hanging the plug strip 100 from, for example, a nail, a hook, or any other suitable hanging mechanism.

In some configurations, the power cord 125*a* of the signal port coupler can include a ground fault circuit interrupter (GFCI) unit 125*f* at the end of the power cord 125*a* (as shown in FIG. 1G). Alternatively, in other configurations, the GFCI unit can be located with the plug strip 100 (e.g., in the base segment 120). The GFCI unit 125*f* can be used to shut off an electric circuit when current is detected as flowing along an unintended path, possibly through water or through a user and thus GFCI units 125*f* can be used to reduce the risk of electric shock. The GFCI unit 125 can measure the current leaving the hot side of a signal port (e.g., a power source) and compare it to the current returning to the neutral side. If the two currents are not equal, this indicates that some of the current is flowing along an unintended path, and the GFCI unit 125*f* can be configured to automatically shut off the supply of power to the plug strip 100. In some configurations, the plug strip 100 can be made to be Occupational Safety and Health Administration (OSHA) certified for specific high-risk job site use by, for example, making the plug strip 100 compliant with OSHA standard 1926.403.

More information regarding the exemplary methods and structure for achieving the above-described movability of the different segments in the plug strip is set forth in the '399 patent incorporated by reference above. The '399 patent also describes exemplary methods and structure for providing power distribution functionality to the base segment and/or each of the intermediate segments and end segments of the first assembly and/or the second assembly.

Figure 2:
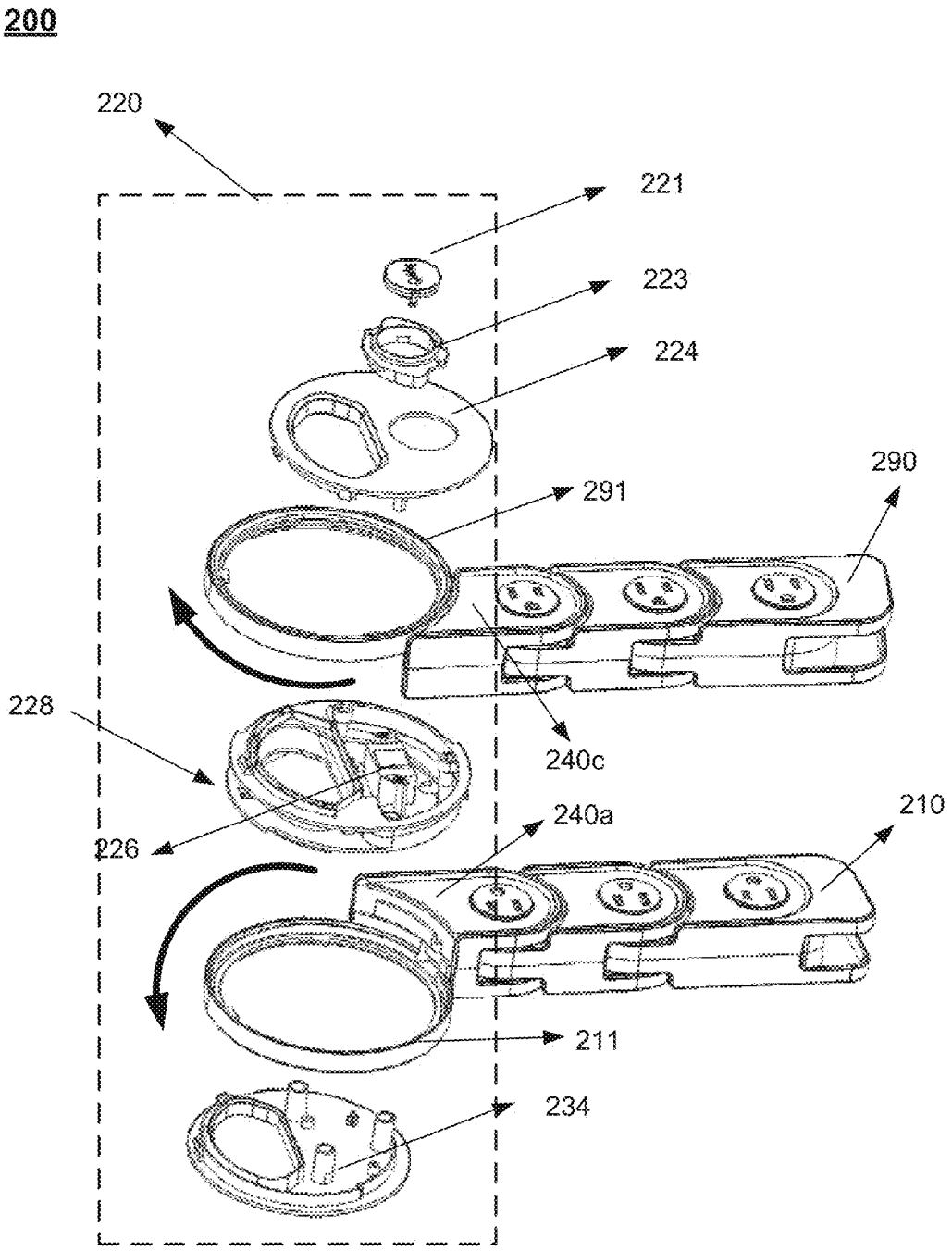
FIG. 2 is a partially exploded perspective view of the plug strip showing the direction of movement of the first assembly and the second assembly, according to an embodiment.

FIG. 2 is a partially exploded perspective view of the plug strip showing the direction of movement of the first assembly and the second assembly, according to an embodiment. FIG. 2 shows that the first assembly 210 is operatively coupled to a ring member 211 that is disposed around the base segment 220 and allows the first assembly 210 to rotate around the base segment 220. Specifically, the ring member 211 is part of and/or attached to the first intermediate segment 240*a* of the first assembly 210 and allows the first intermediate segment 240*a* to rotate around the base segment 220. Similarly, FIG. 2 also shows that that the second assembly 290 is operatively coupled to a ring member 291 that is disposed around the base segment 220 and allows the second assembly 290 to rotate around the base segment 220. Specifically, the ring member 291 is part of and/or attached to the third intermediate segment 240*c* of the second assembly 290 and allows the third intermediate segment 240*c* to rotate around the base segment 220. The mechanical link assembly 228 can serve as a scaffold to hold the ring members 211 and 291 and allows the ring members 211 and 291 to move in a substantially arcuate motion around the mechanical link assembly 228. In the embodiment of the plug strip 200 shown in FIG. 2, the first assembly 210 moves in a counter-clockwise orientation around the base segment 220, and the second assembly 290 move in a clockwise orientation around the base segment 220.

A printed circuit board and switch 226 can form a portion of the electrical connection assembly that can conductively engage the different electrical receptacles of the intermediate and end segments of the first assembly 210 and the second assembly 290 with a signal port. The printed circuit board and switch 226 can also engage the power button 221 when the power button 221 is actuated by a user (e.g., downward force applied on the power button 221 by a user) to define a signal path between a signal port the plug strip 200. The printed circuit board and switch 226 can also include the electrical circuitry to engage the indicator ring 223 to display, for example, a continuous light or a flashing light when the plug strip 200 is in an activated configuration. The top cap 224 serves as a cover for the ring member 291 and is part of the mechanical housing that contains the different components of the base segment 220. Additionally, the top cap 224 also houses the power button 221 and the indicator ring 223. The bottom cap 234 serves as a cover for the ring member 211 and is a part of the mechanical housing that contains the different components of the base segment 220. Additionally, in some configurations, the top cap 224 and/or the bottom cap 234 can include a locking mechanism (e.g., mechanical stoppers) that can be used to limit the motion of the first assembly 210 and/or the second assembly 290 and also lock the first assembly 210 and/or the second assembly 290 in specific locations about the base segment 220.

Figure 3A:
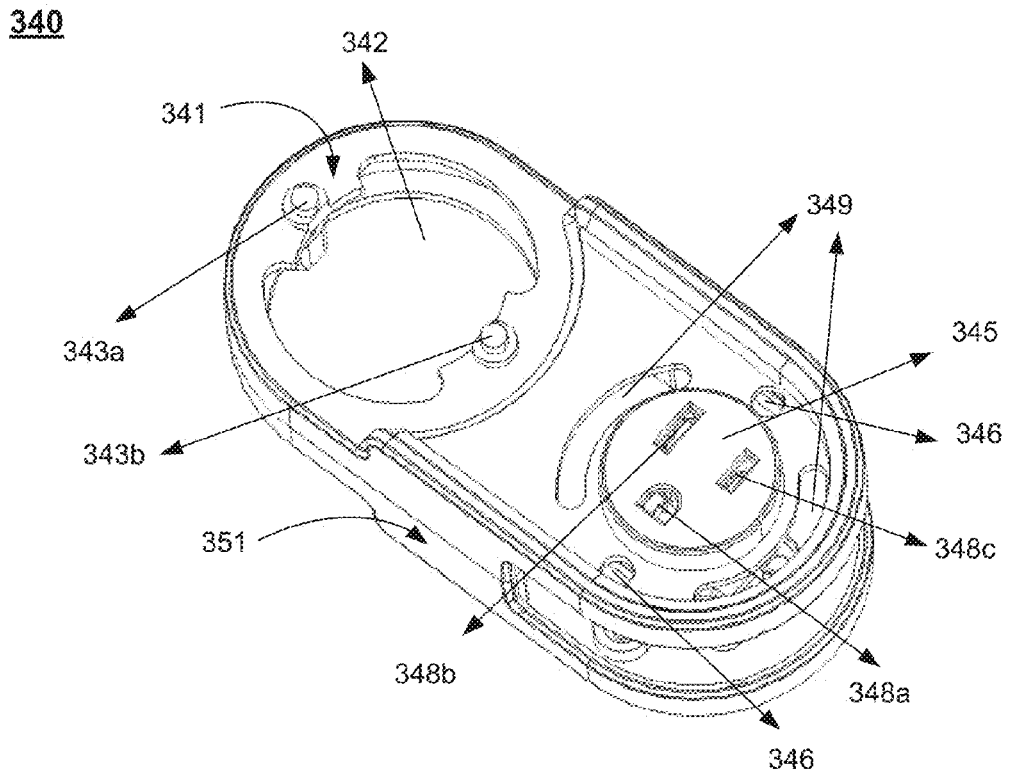
FIG. 3A is a top perspective view of an intermediate segment, according to an embodiment.
Figure 3B:
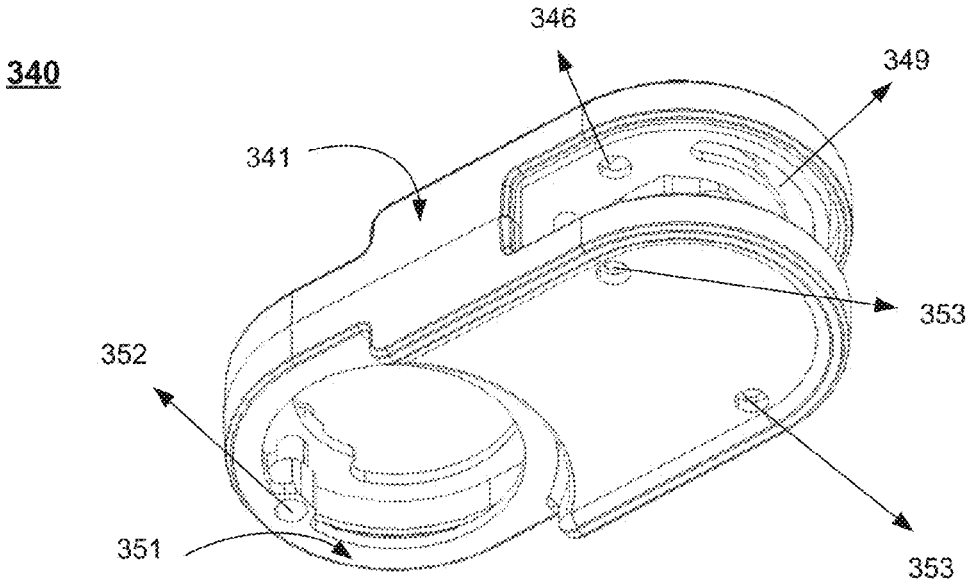
FIG. 3B is a bottom perspective view of an intermediate segment, according to an embodiment.

FIGS. 3A and 3B are a top and bottom perspective views of an intermediate segment, according to an embodiment. The intermediate segment 340 includes a top housing 341 and a bottom housing 351. The top housing 341 defines an aperture 342 that is configured to receive a portion of the top housing of an adjacent intermediate segment when the intermediate segment 340 is connected to an adjacent intermediate segment (e.g., intermediate segment 140*a* connected to intermediate segment 140*b* as seen in FIG. 1A). The aperture 342 that can also be configured to receive a portion of the base segment when the intermediate segment 340 is connected to a base segment (e.g., intermediate segment 140*a* to base segment 120 as seen in FIG. 1A). The intermediate segment 340 includes a pair of rotation posts 343*a* and 343*b* that can be disposed in the pair of arcuate rotation channels 349 defined by an adjacent or neighboring intermediate segment to allow pivotal movement of the intermediate segment 340 with respect to the adjacent or neighboring intermediate segment. The range of angles of motion of an intermediate segment 340 with respect to an adjacent or neighboring intermediate segment is defined by the size and the curvature of the rotation channels 349. In the embodiment of the intermediate segment 340 shown in FIGS. 3A and 3B, the rotation post 343*a* is longer in size than the rotation post 343*b* and can be disposed in the rotation post anchor 352 of the bottom housing to secure the top housing 341 to the bottom housing 351. The intermediate segment 340 also includes an electrical receptacle 345 that is configured to receive at least an electrically conductive portion of an external device plug. The electrical receptacle 345 includes a ground receptacle 348*a*, a live receptacle 348*b* and a neutral receptacle 348*c*. The ground receptacle 348*a* can receive and electrically engage with the ground prong of an external electrical device plug, the live receptacle 348*b* can receive and electrically engage with the live prong of an external electrical device plug, and the neutral receptacle 348*c* can receive and electrically engage with the neutral prong of an external electrical device plug.

Figure 3C:
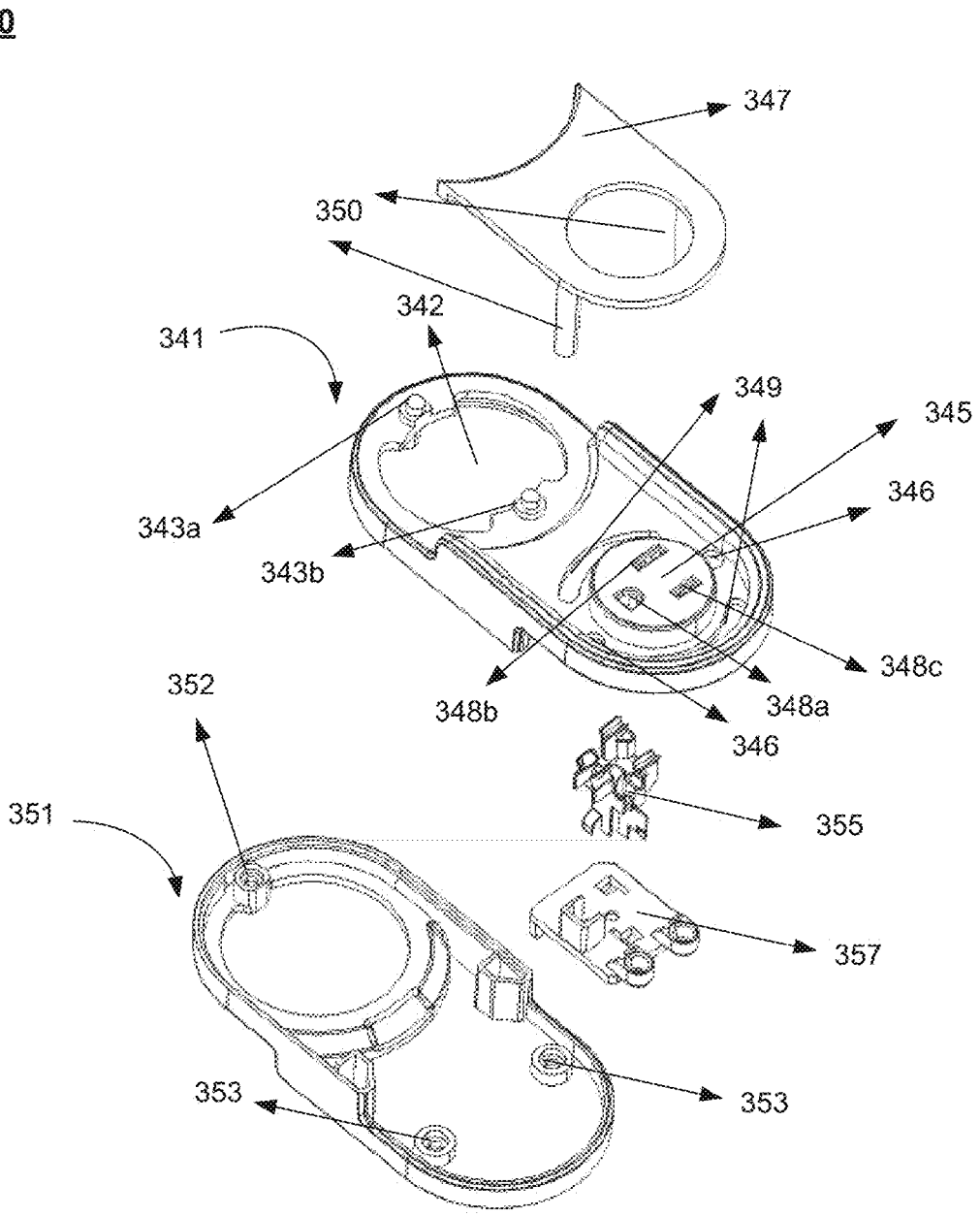
FIG. 3C is a partially exploded perspective view of an intermediate segment, according to an embodiment.

FIG. 3C is a partially exploded perspective view of an intermediate segment, according to an embodiment. The intermediate segment 340 includes a cap 347 that can function as a protective covering for the intermediate segment 340, can function as a decorative component, and can also secure the top housing 341 with the bottom housing 351 of the intermediate segment 340. The cap 347 includes two cap posts 350 that can be disposed through the cap post aperture 346 in the top housing 341 and mechanically engage with the cap post anchor 353 in the bottom housing 351 to secure the top housing 341 with the bottom housing 351. The electrical receptacle 345 also includes the electrical contact assembly 355 and the electrical contact plate assembly 357. The electrical contact assembly 355 and the electrical contact plate assembly 357 can together define the electrical connection assembly for the intermediate segment 340 and can include components such as, for example, a live connector, a neutral connector, a ground connector, etc. The electrical connection assembly can collectively define a portion of a power (or electrical signal) pathway between the intermediate segment 340 and a signal port (e.g., an external electrical power outlet), a base segment, an end segment, an adjacent inter segment, or an external device plug. The electrical connection assembly thus can be configured to receive an electrical signal from and/or send an electrical signal to a signal port, a base segment, an end segment, an adjacent intermediate segment, or an external device plug. The electrical connection assembly can also allow for maintaining electrical contact between the intermediate segment 340 and an adjacent intermediate segment through the entire range of motion of the intermediate segment 340 with respect to the adjacent intermediate segment. Similarly, the electrical connection assembly can also allow for maintaining electrical contact between the intermediate segment 340 and the base segment through the entire range of motion of the intermediate segment 340 with respect to the base segment.

Figure 4A:
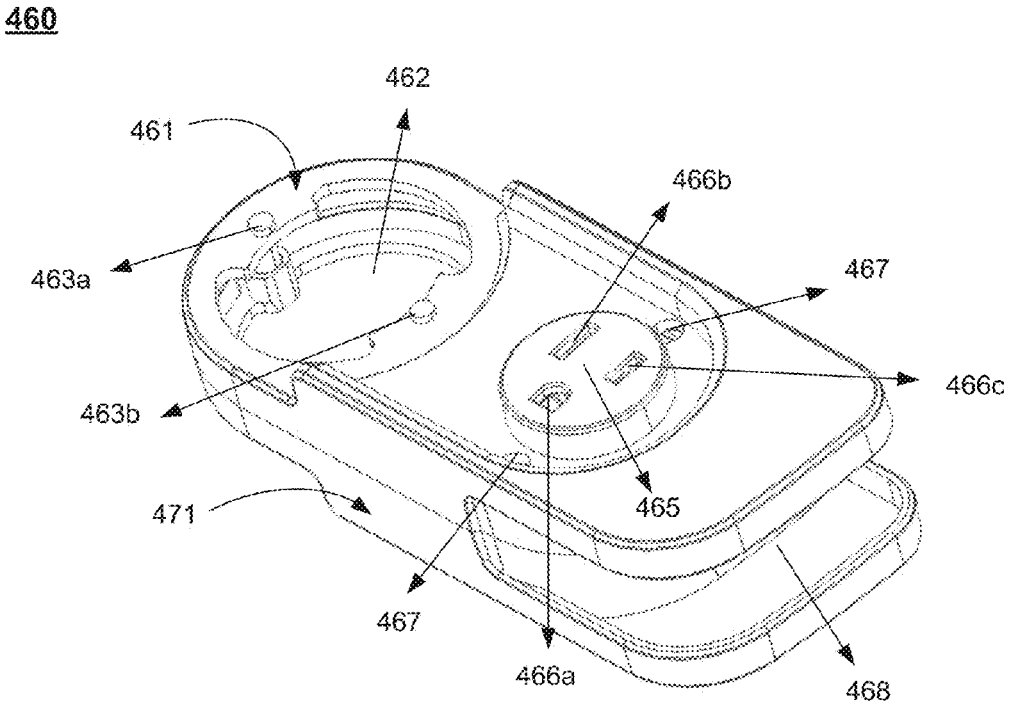
FIG. 4A is a top perspective view of an end segment, according to an embodiment.
Figure 4B:
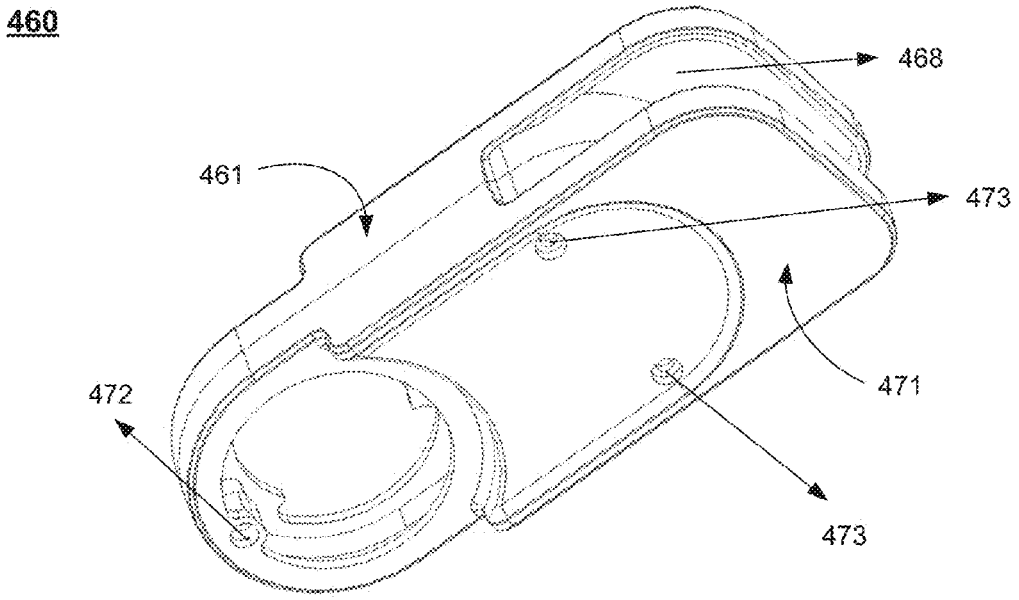
FIG. 4B is a bottom perspective view of an end segment, according to an embodiment.

FIGS. 4A and 4B are a top and bottom perspective views of an end segment, according to an embodiment. Many of the components of the end segment 460 shown in FIGS. 4A and 4B are substantially similar in form and function to the corresponding components of the intermediate segment described in FIGS. 3A-3C. The end segment 460 includes a top housing 461 and a bottom housing 471. The top housing 461 defines an aperture 462 that is configured to receive a portion of the top housing of an adjacent intermediate segment when the end segment 460 is connected to an adjacent intermediate segment (e.g., end segment 160*a* connected to intermediate segment 145*b* as seen in FIG. 1A). The end segment 460 includes a pair of rotation posts 463*a* and 463*b* that can be disposed in the pair of arcuate rotation channels defined by an adjacent intermediate segment (e.g., rotation channels 349 as shown in FIGS. 3A and 3C) to allow pivotal movement of the end segment 460 with respect to an adjacent intermediate segment. The range of angles of motion of an end segment 460 with respect to an adjacent intermediate segment is defined by the size and the curvature of the rotation channels in the intermediate segment (e.g., rotation channels 349 as shown in FIGS. 3A and 3C). In the embodiment of the end segment 460 shown in FIGS. 4A and 4B, the rotation post 463*a* is longer in size than the rotation post 463*b* and can be disposed in the rotation post anchor 472 of the bottom housing 471 to secure the top housing 461 to the bottom housing 471. Note that unlike the intermediate segments, the end segment 460 does not include any rotation channels as the end segment 460 defines the termination point of an assembly of the plug strip. Hence, only one end of the end segment is movably coupled to an intermediate segment. The end segment 460 includes a recess 468 that is configured to receive a portion of a signal port coupler (e.g., see plug strip configuration in FIG. 1G).

Figure 4C:
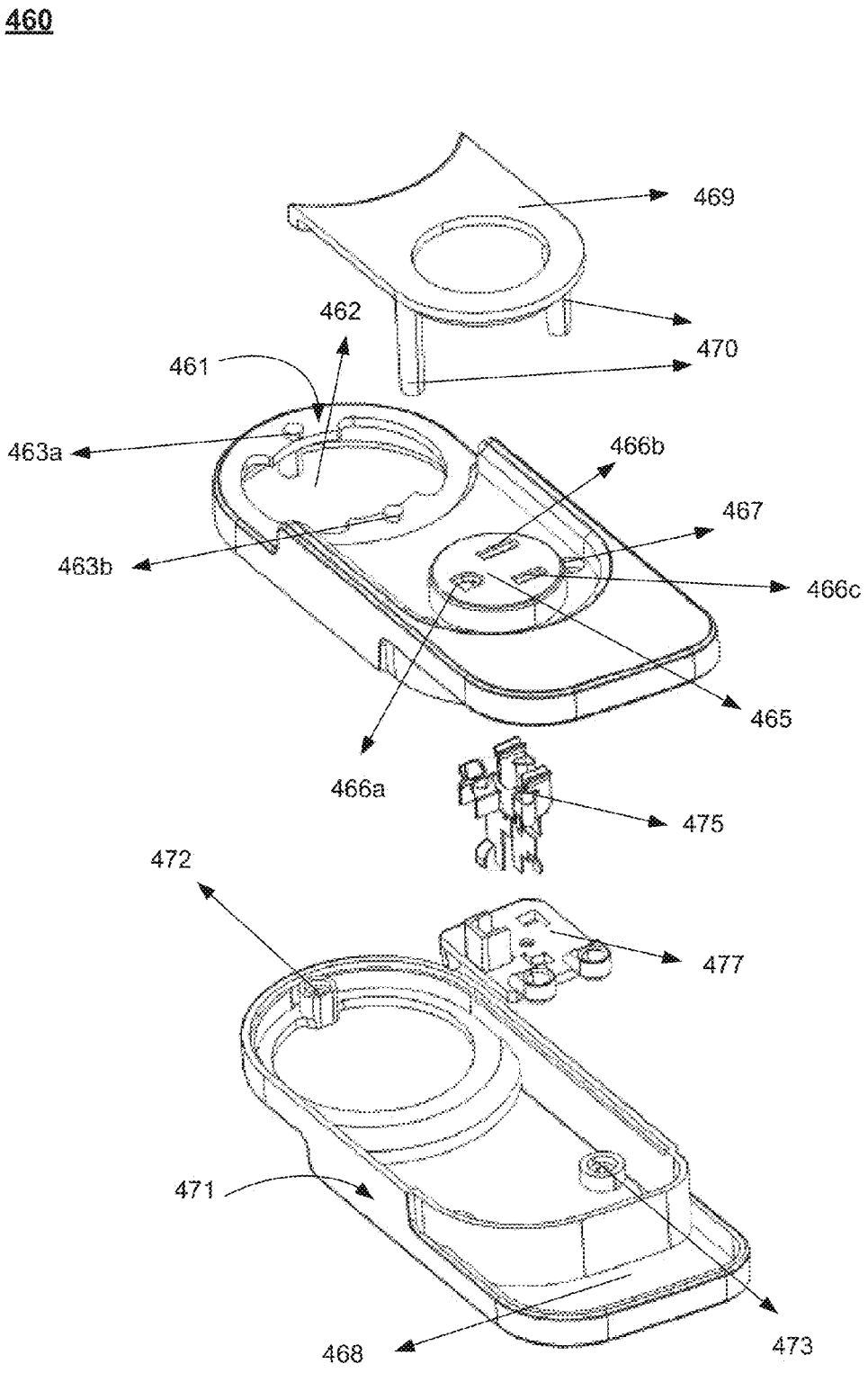
FIG. 4C is a partially exploded perspective view of an end segment, according to an embodiment.

FIG. 4C is a partially exploded perspective view of an end segment, according to an embodiment. The end segment 460 includes a cap 469 that can function as a protective covering for the end segment 460 and can also secure the top housing 461 with the bottom housing 471 of the end segment 460. The cap 469 includes two cap posts 470 that can be disposed through the cap post aperture 467 in the top housing 461 and mechanically engage with the cap post anchor 473 in the bottom housing 471 to secure the top housing 461 with the bottom housing 471. The end segment 460 also includes an electrical receptacle 465 that is configured to receive at least an electrically conductive portion of an external device plug. The electrical receptacle 465 includes a ground receptacle 466*a*, a live receptacle 466*b* and a neutral receptacle 466*c*. The ground receptacle 466*a* can receive and electrically engage with the ground prong of an external electrical device plug, the live receptacle 466*b* can receive and electrically engage with the live prong of an external electrical device plug, and the neutral receptacle 466*b* can receive and electrically engage with the neutral prong of an external electrical device plug. The electrical receptacle 465 includes the electrical contact assembly 475 and the electrical contact plate assembly 477. Similar to the case of the intermediate segment, the electrical contact assembly 475 and the electrical contact plate assembly 477 of the end segment 460 can together define the electrical connection assembly for the end segment 460 and can include components such as, for example, a live connector, a neutral connector, a ground connector, etc. The electrical connection assembly can collectively define a portion of a power (or electrical signal) pathway between the end segment 460 and a signal port (e.g., an external electrical power outlet), a base segment, an adjacent intermediate segment, or an external device plug. The electrical connection assembly thus can be configured to receive an electrical signal from and/or send an electrical signal to a signal port, a base segment, an adjacent intermediate segment, or an external device plug. The electrical connection assembly can also allow for maintaining electrical contact between the end segment 460 and an adjacent intermediate segment through the entire range of motion of the end segment 460 with respect to the adjacent intermediate segment.

Figure 5:
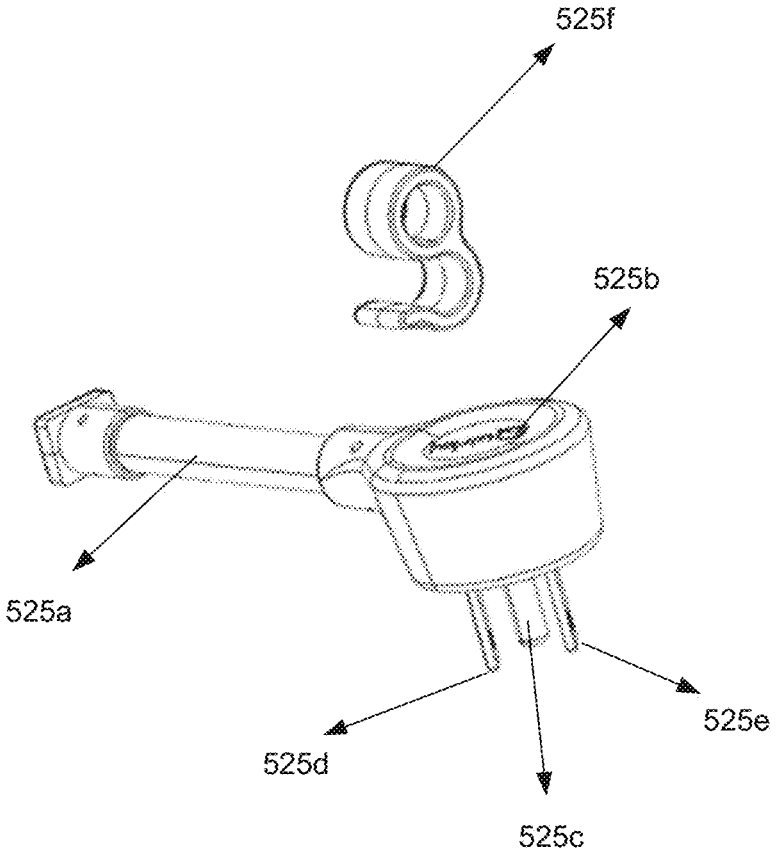
FIG. 5 is a partially exploded perspective view of a signal port coupler, according to an embodiment.

FIG. 5 is a partially exploded perspective view of a signal port coupler, according to an embodiment. The signal port coupler 525 includes a power cord 525*a*, a 3-prong power plug 525*b* that includes a ground prong 525*c*, a live prong 525*d* and a neutral prong 525*e*, and a cable clip 525*f*. The power cord 525*a* can be used to establish a power (or electrical signal flow) pathway between a signal port and the base segment and/or the different intermediate segments and/or the different end segments of the first assembly and the second assembly. Such a power pathway can be established when a user actuates the power button to set the plug strip to a first configuration (i.e., an "on" state). In some instances, the plug strip can include a retraction mechanism to retract at least a portion of the power cord 525*a*. In other instances, a portion of the power cord 525*a* can be passed through the base segment recess (e.g., base segment recess 122 as shown in FIG. 1) and the end segment recess (e.g., end segment recess 168*a* and 168*b*) to wrap the signal port coupler 525 around the plug strip (see FIG. 1G). As described above, in some configurations, the signal port coupler 525 can also be operably coupled to a ground fault circuit interrupter (GFCI) unit as shown in FIG. 1G. The 3-prong power plug 525*b* can enter and electrically engage with, for example, a three-receptacle external signal port (e.g., an external wall power outlet). The ground prong 525*c* can enter and electrically engage with the ground receptacle of the external signal port, the live prong 525*d* can enter and electrically engage with the live receptacle of the external signal port, and the neutral prong 525*e* can enter and electrically engage with the neutral receptacle of the external signal port. The cable clip 525*f* is attached to the power cord 525*a* and can be used to hold the power cord 525*a* in place when the power cord 525*a* is wrapped around the plug strip as shown in FIG. 1G.

Figure 6:
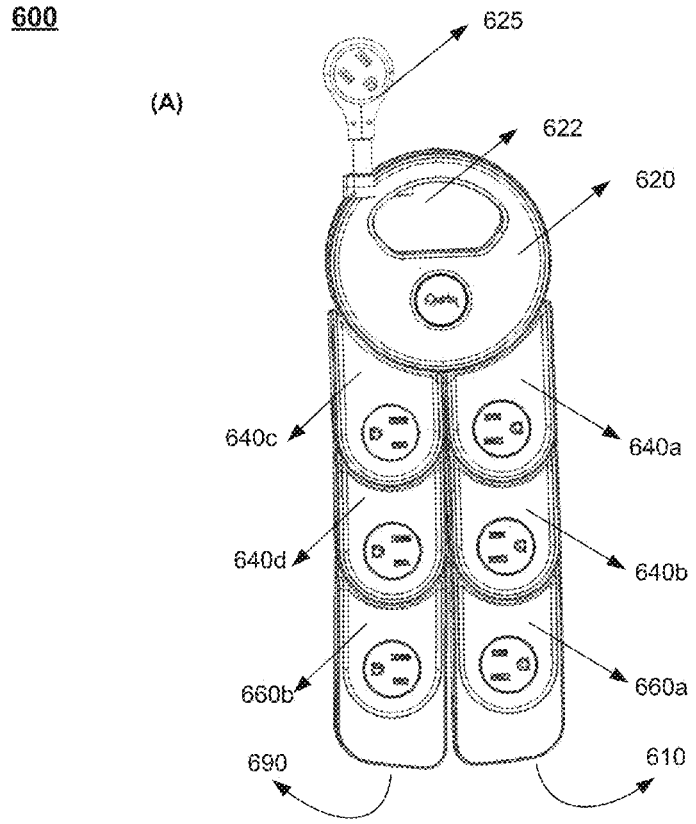
FIG. 6A shows the plug strip in a first configuration, according to an embodiment.
FIG. 6B shows the plug strip in a second configuration, according to an embodiment.
FIG. 6C shows the plug strip in a third configuration, according to an embodiment.
Figure 6:
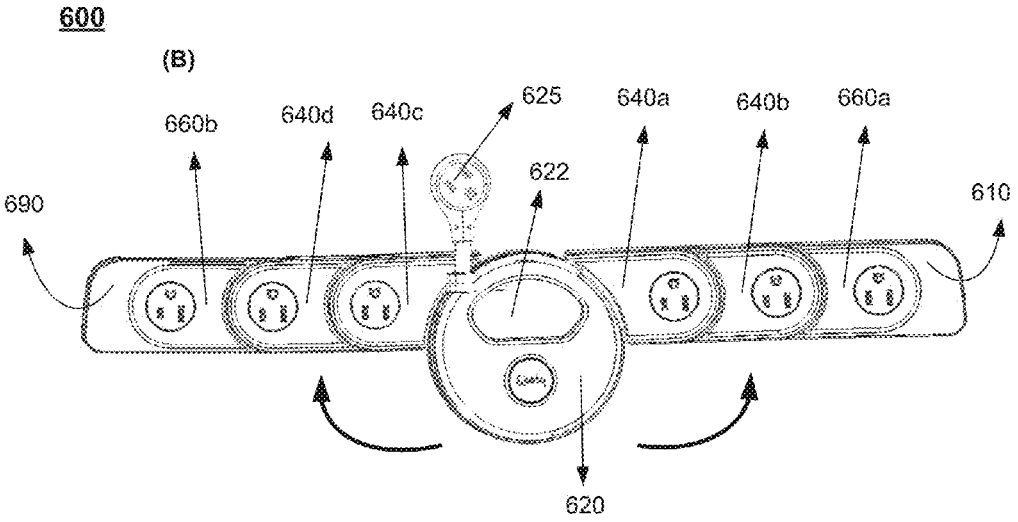
Figure 6:
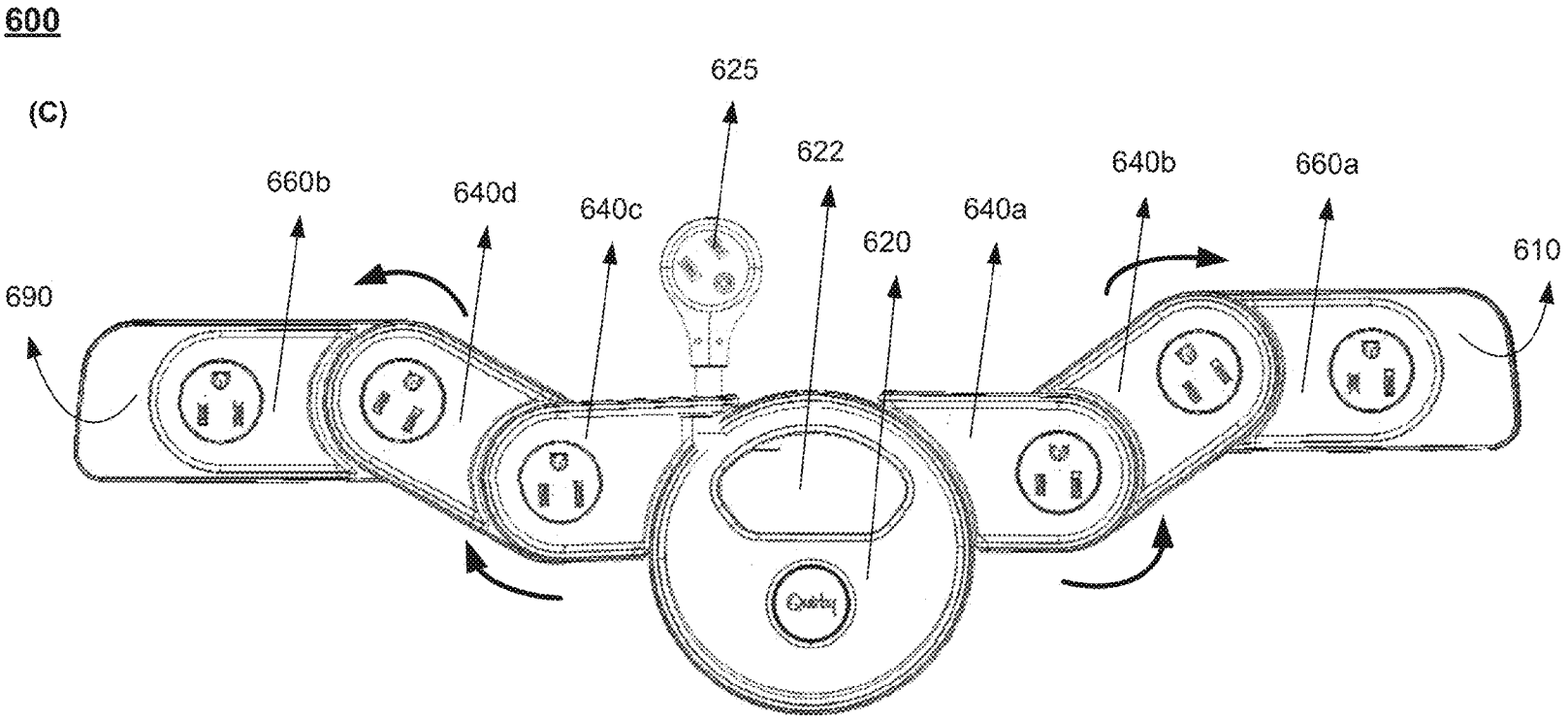

FIGS. 6A-6C shows the plug strip in three different configurations, according to an embodiment. FIG. 6A shows the plug strip 600 in a first configuration where the first assembly 610 is in a first position and the second assembly 690 is in a first position and two assemblies and are substantially collinear. FIG. 6B shows the plug strip 600 in a second configuration where the first assembly 610 is in a second position which rotated and offset from the first position, and the second assembly 690 is in a second position which is also rotated and offset from the first position. In the second configuration, the first assembly 610 has rotated about the base segment 620 in a counter-clockwise direction (as indicated by the dark arrow), and the second assembly 690 has rotated about the base segment 620 in a clockwise direction (as indicated by the dark arrow).

FIG. 6C shows the plug strip 600 in a third configuration where the first assembly 610 is in a second position which is rotated and offset from the first position, and the second assembly 690 is in a second position which is also rotated and offset from the first position. In the third configuration, in the first assembly 610, the second intermediate segment 640*b* has rotated in a counter-clockwise direction about the first intermediate segment 640*a* (as shown by the arrow), and the end segment 660*a* has rotated in a clockwise direction about the second intermediate segment 640*b* (as shown by the arrow). In the third configuration, in the second assembly 690, the fourth intermediate segment 640*d* has rotated in a clockwise direction about the third intermediate segment 640*c* (as shown by the arrow), and the end segment 660*b* has rotated in a counter-clockwise direction about the fourth intermediate segment 640*d* (as shown by the arrow). The rotation of the first assembly 610 and the second assembly 690 around the base segment 120 and each of the intermediate and end segments is implemented so as to minimize gaps between parts of the plug strip and is achieved by making the base segment 620 functions as a pivot centre.

Each of the components of the plug strips discussed herein can be monolithic or a combination of parts. By way of example, with reference to FIG. 3A, rotation posts 343*a* and 343*b* and the receptacle 345 of top housing 341 can be a single piece. In other embodiments, rotation posts 343*a* and 343*b* can be separate from the top housing 341 and can be permanently or temporarily fixed to the top housing 341. Each of the components of the plug strip described herein can be cast (molded) into a final shape or configuration, may be manipulated (stamped and/or bent) into the final shape or configuration, and/or may be cast and manipulated into the final shape or configuration. Conducting components, such as the electrical contact assembly 355 can include any known conducting material, such as a metal or metal alloy, and non-conducting, insulating, and/or support members can include any know insulating material, such as a plastic, polymer, etc.

While various embodiments have been described above, it should be understood that they have been presented by way of example only, not limitation, and various changes in form and details may be made. While the plug strip is shown and described as having a certain number of intermediate and/or end segments, in some embodiments, more or fewer intermediate and/or end segments can be included. While the plug strip is shown and/or described as having certain configurations (i.e. straight, sinusoid, and circular), in some embodiments, the plug strips can have virtually any configuration based, at least, on the number of intermediate and/or end segments and/or characteristics of the intermediate and/or end segments. While the intermediate and/or end segments are shown and/or described as rotating about a single axis, in some embodiments, the intermediate and/or end segments can move relative to one another in more than one plane and/or axis, such as, for example, twisting about an axis perpendicular to the surface of a electrical receptacle, bending about an axis perpendicular to the surface of a electrical receptacle, translating along an axis, and/or combinations of such relative movements.

While shown and/described as a 120V three prong plug, the plug strip described herein can be configured for other power sources, audio, video and/or data sources, or combinations of sources, such as, for example, universal serial bus, Fire Wire, international power standards, etc. In such embodiments, the plug strip and associated intermediate and/or end segments can have more or fewer signal paths, and more or fewer associated components in accordance with the signal requirements, such as, for example, connectors, tracks, insulation members, support members, etc. Furthermore, the components shapes and characteristics of the components can be modified based on the type of outlet/plug and the number of associated components.

Other aspects of the plug strips shown and described can be modified to affect the performance and/or characteristics of the plug strip. By way of example, in some embodiments, the range of relative motion of the intermediate segments and/or end segments can be defined by the size and/or shape of the rotation channel, the size, shape, and/or number of rotation posts, and/or the type of plug/outlet. While power button 221 is shown and described as a button, in some embodiments, power button 221 can be a toggle, rocker, slider, etc. Similarly, indicator ring 223 can be any indicator, such as, for example, a uniform light source, non-uniform light source, can indicate on and/or off, etc. The plug strip can also include additional device protections, such as, for example, fuses, breakers, surge protection elements, etc.

Any portion of the apparatus and/or methods described herein may be combined in any combination, except mutually exclusive combinations. The embodiments described herein can include various combinations and/or sub-combinations of the functions, components and/or features of the different embodiments described.

The invention claimed is:

1. An apparatus, comprising:

a base segment including a signal port coupler;

a first assembly including a first segment having a first receptacle configured to receive at least an electrically conductive portion of a first device plug, the first segment coupled to the base segment for pivotal movement relative to the base segment;

a second assembly including a second segment having a second receptacle configured to receive at least an electrically conductive portion of a second device plug, the second segment coupled to the base segment for pivotal movement relative to the base segment;

a third segment; and an electrical connection assembly disposed in the base, first, and second segments and configured to selectively conductively engage the receptacles of the first and second segments with a signal port, wherein the base segment includes a first recess configured to receive at least a first portion of the signal port coupler and wherein the third segment includes a second recess configured to receive at least a second portion of the signal port coupler.

2. The apparatus of claim 1, wherein the base segment includes an arcuate surface configured to mate with the first segment of the first assembly and with the second segment of the second assembly.

3. The apparatus of claim 1, wherein the base segment is substantially circular.

4. The apparatus of claim 1, wherein the base segment includes an aperture.

5. The apparatus of claim 1, wherein the signal port coupler includes a power cord.

6. The apparatus of claim 1, wherein the first assembly is configured to rotate about the base segment from a first position to a second position.

7. The apparatus of claim 6, wherein the second position is up to 90 degrees offset from the first position.

8. The apparatus of claim 1, wherein the second assembly is configured to rotate about the base segment from a first position to a second position.

9. The apparatus of claim 8, wherein the second position is up to 90 degrees offset from the first position.

10. The apparatus of claim 1, further comprising: an indicator configured to visually indicate to a user when a circuit is conductively engaged and/or disengaged.

11. The apparatus of claim 10, wherein the indicator is a uniform light source.

12. The apparatus of claim 10, wherein the indicator is a non-uniform light source.

13. The apparatus of claim 1, further comprising: a ground fault circuit interrupter (GFCI) configured to provide electrical protection for the apparatus.

14. The apparatus of claim 1, wherein the base segment includes an aperture configured to allow a user to grasp the apparatus.

15. An apparatus, comprising:

a base segment including a signal port coupler;

a first assembly including a first segment having a single receptacle configured to receive at least an electrically conductive portion of a first device plug, the first segment coupled to the base segment for pivotal movement relative to the base segment;

a second assembly including a second segment having a single receptacle configured to receive at least an electrically conductive portion of a second device plug, the second segment coupled to the base segment for pivotal movement relative to the base segment;

a third segment; and an electrical connection assembly disposed in the base, first, and second segments and configured to selectively conductively engage the receptacles of the first and second segments with a signal port, wherein the base segment includes a first recess configured to receive at least a first portion of the signal port coupler and wherein the third segment includes a second recess configured to receive at least a second portion of the signal port coupler.

16. The apparatus of claim 15, wherein the base segment includes a switch assembly configured to allow a user to selectively electrically couple a power source to the receptacles in the first and second segments.

17. The apparatus of claim 15, wherein the electrical connection assembly includes a flexible wire.

18. The apparatus of claim 15, wherein the third segment comprises a single receptacle configured to receive at least an electrically conductive portion of a third device plug, the third segment coupled one of to the first segment and the second segment for pivotal movement relative thereto, wherein the electrical connection assembly is disposed in the third segment and is configured to selectively conductively engage the single receptacle of the third segment with a signal port.

19. The apparatus of claim 18, wherein one of the first segment and the second segment includes a third recess configured to receive at least a third portion of the signal port coupler.

20. An apparatus, comprising:

a base segment including a signal port coupler;

a first assembly including a first segment having a first receptacle configured to receive at least an electrically conductive portion of a first device plug, the first segment including a ring member disposed about the base segment and configured to allow the first segment to rotate around the base segment;

a second assembly including a second segment movably coupled to the base segment, the second segment including a third receptacle configured to receive at least an electrically conductive portion of a second device plug, the second segment including a ring member disposed about the base segment and configured to allow the second segment to rotate around the base segment;

a third segment; and an electrical connection assembly disposed in the base, first, and second segments and configured to selectively conductively engage the receptacles of the first and second segments with a signal port, wherein the base segment includes a first recess configured to receive at least a first portion of the signal port coupler and wherein the third segment includes a second recess configured to receive at least a second portion of the signal port coupler.

* * * * *